US008412059B2

(12) United States Patent
Nishida et al.

(10) Patent No.: US 8,412,059 B2
(45) Date of Patent: Apr. 2, 2013

(54) IMAGE FORMING DEVICE AND IMAGE FORMING METHOD

(75) Inventors: Akinori Nishida, Kyoto (JP); Takaaki Kamei, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 323 days.

(21) Appl. No.: 13/009,885

(22) Filed: Jan. 20, 2011

(65) Prior Publication Data

US 2011/0182595 A1 Jul. 28, 2011

(30) Foreign Application Priority Data

Jan. 25, 2010 (JP) ..... 2010-012790

(51) Int. Cl.
*G03G 15/08* (2006.01)

(52) U.S. Cl. ..... 399/27

(58) Field of Classification Search ..... 399/27, 399/29, 30, 61, 62, 64, 43
See application file for complete search history.

(56) References Cited

U.S. PATENT DOCUMENTS 5,214,476 A * 5/1993 Nomura et al. ..... 399/30
5,257,076 A * 10/1993 Nishimura et al. ..... 399/27
7,013,093 B2 * 3/2006 Nakazato ..... 399/27
2006/0204256 A1 * 9/2006 Sakamoto ..... 399/27
2006/0263106 A1 * 11/2006 Yamaguchi et al. ..... 399/27

FOREIGN PATENT DOCUMENTS

JP 01133071 A * 5/1989
JP 2005-181597 A 7/2005
JP 2008-256876 A 10/2008
JP 2009-103788 A 5/2009

* cited by examiner

*Primary Examiner* — Susan Lee
(74) *Attorney, Agent, or Firm* — Keating & Bennett, LLP

(57) ABSTRACT

In an image forming device, toner in a developing unit is efficiently utilized. A printing unit includes a developing unit, a toner cartridge, a photo-electronic sensor, a CPU and a counter. The toner cartridge replenishes toner to the developing unit at one time. The photo-electronic sensor detects toner in the developing unit. The CPU processes an output signal from the photo-electronic sensor to create comparison data, then compares comparison data with a predetermined threshold and issues an alarm when the comparison data exceeds the predetermined threshold. The counter counts the number of times that toner is replenished to the developing unit. The CPU changes the threshold to a level at which an alarm is hardly issued as the number of counts in the counter increases.

7 Claims, 10 Drawing Sheets

IMAGE FORMING DEVICE AND IMAGE FORMING METHOD

CROSS-REFERENCE TO RELATED APPLICATIONS

This application claims priority under 35 U.S.C. 119 to Japanese Patent Application No. 2010-012790, filed on Jan. 25, 2010, which application is hereby incorporated by reference in its entirety.

BACKGROUND OF THE INVENTION

1. Field of the Invention

The present invention relates to an image forming device and an image forming method. More particularly, the present invention relates to an image forming device and an image forming method including a toner cartridge arranged to supply toner to a developing unit all at one time.

2. Description of Related Art

An electrophotographic image forming device has a photosensitive body, exposing unit, developing unit, transfer unit and fusing unit as main components. When the developing unit supplies toner to a photosensitive drum, the toner is attached to an electrostatic latent image formed on a surface of a photosensitive drum by an exposing unit, and as a result, the electrostatic latent image is developed as a toner visible image. Thereafter, the transfer unit transfers the toner visible image onto paper, and, further, the fusing unit fuses the toner visible image on paper by heating and applying pressure.

The remaining toner in the developing unit is important information for maintenance and management. Hence, there is known an image forming device that is provided with a toner concentration sensor in the developing unit to detect a toner concentration in the developing unit. The toner concentration sensor detects that toner in the developing unit becomes empty when an output continuously goes below a threshold a predetermined number of times. In this image forming device, toner is replenished from a toner bottle to the developing unit during each toner replenishing operation. In contrast, there is also known an image forming device of a type of replenishing the total amount of toner in a toner unit to the developing unit at one time.

In the latter image forming device, toner is replenished in a state where some toner still remains in the developing unit. This is because a roller and other components are likely to deteriorate when the developing unit is driven in a state where the toner has completely run out.

SUMMARY OF THE INVENTION

Therefore, preferred embodiments of the present invention provide an imagine forming device that efficiently utilizes toner in a developing unit in an image forming device.

According to a preferred embodiment of the present invention, the image forming device includes a developing unit, a toner cartridge, a toner sensor, a signal processing unit and a counter. The toner cartridge replenishes toner to the developing unit at one time. The toner sensor detects toner in the developing unit. The signal processing unit processes an output signal from the toner sensor to create comparison data, then compares the comparison data with a predetermined threshold, and issues an alarm when the comparison data exceeds the predetermined threshold. The counter counts the number of times that toner is replenished to the developing unit. As the number of counts in the counter increases, the signal processing unit changes the threshold to a level at which an alarm is hardly issued.

In a conventional technique, in an image forming device of a type that replenishes the total amount of toner in the toner unit to the developing unit at one time, remaining toner in the developing unit increases every time the toner cartridge is exchanged. Therefore, conventionally, as the number of times of exchanging a toner cartridge increases, toner that remains in the developing unit when the toner cartridge is exchanged increases. This problem with the related art was newly discovered by the inventors of the invention described and claimed in the present application.

With the device according to a preferred embodiment of the present invention, as the number of times of exchanging a toner cartridge increases, the signal processing unit changes a threshold to be compared with data, to a level at which an alarm is hardly issued. Consequently, remaining toner in the developing unit hardly increases every time the toner cartridge is exchanged, and as a result, toner in the developing unit is efficiently utilized.

According to a preferred embodiment of the present invention, a developing unit preferably includes an agitator, a toner sensor is a photo-electronic sensor and the photo-electronic sensor repeats a light transmitting state and a light blocking state with agitation of toner by the agitator. The signal processing unit measures a light blocking period or the rate of the light blocking period of the photo-electronic sensor as the comparison data. The signal processing unit may decrease the threshold as the number of counts in a counter increases.

According to a preferred embodiment of the present invention, when the light blocking period or the rate of the light blocking period of the photo-electronic sensor becomes smaller than the threshold, the signal processing unit issues an alarm. Moreover, the signal processing unit decreases the threshold every time the toner cartridge is exchanged, so that remaining toner in the developing unit hardly increases every time the toner cartridge is exchanged, and as a result, toner in the developing unit is efficiently utilized.

According to a preferred embodiment of the present invention, the counter may be counted up every time the signal processing unit issues an alarm. In this device, the counter is already counted up when the toner cartridge is exchanged.

According to a preferred embodiment of the present invention, remaining toner in the developing unit hardly increases every time the toner cartridge is exchanged, and as a result, toner in the developing unit is efficiently utilized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
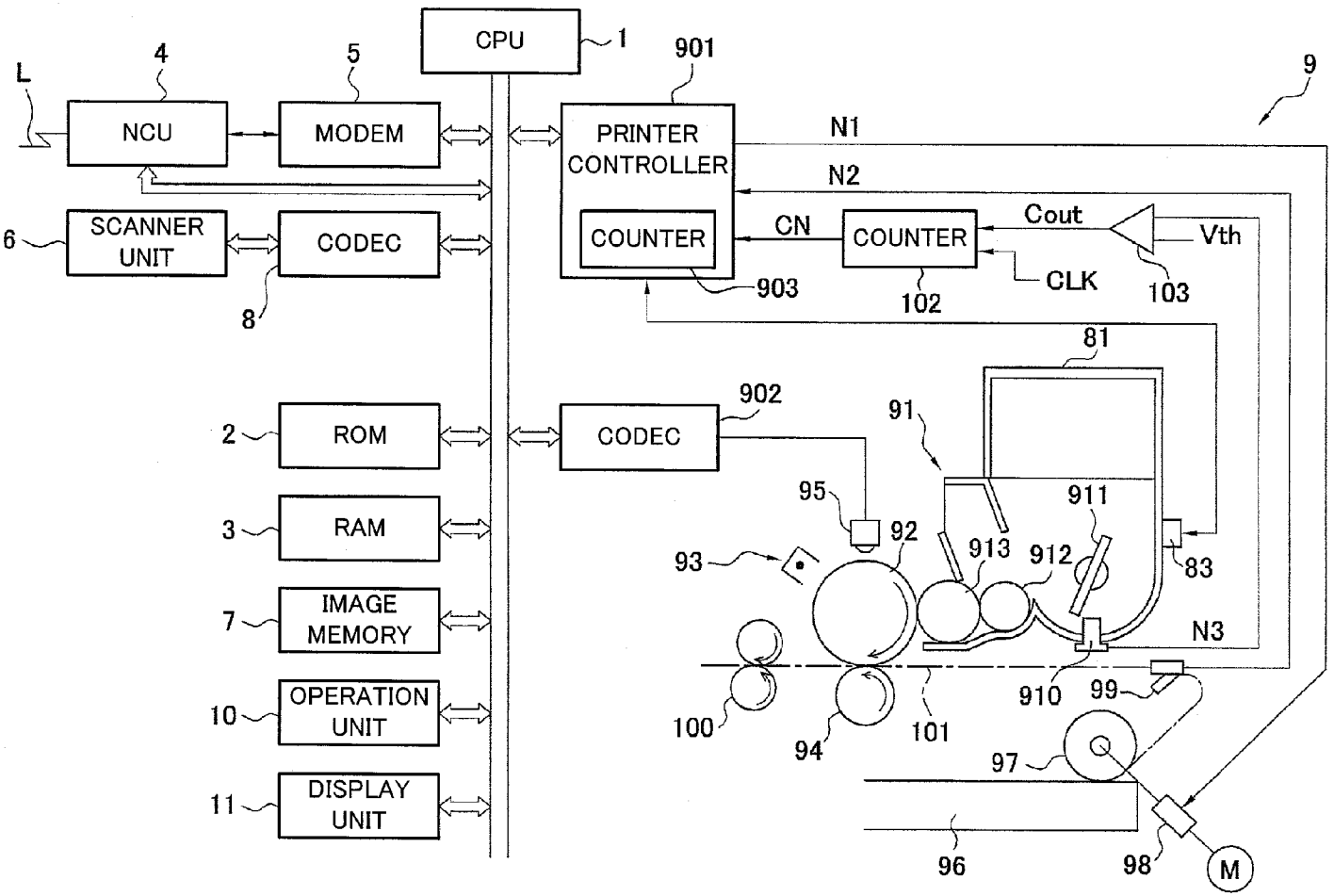
FIG. 1 is a block diagram illustrating a configuration of an image forming device according to a preferred embodiment of the present invention.

An image forming device will be described with reference to FIG. 1. FIG. 1 is a block diagram illustrating a configuration of the image forming device according to a preferred embodiment of the present invention.

In the present preferred embodiment, the image forming device preferably is included in a facsimile machine, for example. In FIG. 1, the facsimile machine preferably includes a Central Processing Unit (CPU) 1, a Read Only Memory (ROM) 2 and a Random Access Memory (RAM) 3 that are mutually connected. The CPU 1 functions as a controlling unit of the facsimile machine. The ROM 2 stores in advance, for example, a program that controls the operation of the entire facsimile machine. The RAM 3 functions as a storing unit to store data that is required for control in the CPU 1 and data that needs to be stored temporarily upon performance of the control operation.

Further, the CPU 1 is connected with a Network Control Unit (NCU) 4 and a modem 5. The NCU 4 has a function of, under control of the CPU 1, controlling connection between a public switched telephone network L and the facsimile machine, and has a function of outputting dial pulses matching a telephone number of a communicating party and a function of detecting an incoming call. The modem 5 modulates transmit data and demodulates received data, that is, modulates transmit data that is a digital signal to an analog audio signal to output the same to the network L through the NCU 4 and, on the contrary, demodulates an analog audio signal received from the network L through the NCU 4 to a digital signal.

The CPU 1 is further connected with a scanner unit 6, an image memory 7, a coder and decoder (CODEC) 8, a printing unit 9, an operation unit 10 and a display unit 11. The scanner unit 6 scans a document image by a scanner such as a charge coupled device (CCD) image sensor. The image memory 7 stores image data scanned by the scanner unit 6, and stores the image data received from the outside through the network L and modem 5. The CODEC 8 codes image data to be transmitted, and decodes the received image data. Although the details will be described later, the printing unit 9 is an example of the image forming device according to a preferred embodiment of the present invention, and prints on paper the received image data or the image data scanned by the scanner unit 6.

The operation unit 10 preferably includes numerical keys for inputting numbers such as a telephone number, one-touch keys, abbreviated dial keys and operation keys for instructing various operations. The display unit 11 is preferably configured by a cathode ray tube (CRT) display or a liquid crystal display (LCD), for example, to display various pieces of information such as a telephone number inputted by operating the operation unit 10 and remaining toner in the developing unit of the printing unit 9.

Next, as the image forming device according to a preferred embodiment of the present invention, the printing unit 9 is connected to the CPU 1 through a printer controller 901. The printer controller 901 includes a CPU (not illustrated), and directly controls the operation of the printing unit 9. Further, an image signal from the CODEC 902 is inputted to an LED array head 95 that will be described later. The CODEC 902 expands the compressed image data to a bit image, and outputs the bit image as an image signal.

The printing unit 9 preferably includes a developing unit 91, a photosensitive drum 92, a charger 93 and a transfer roller 94, similar to a conventional electrophotographic image forming device. In addition, in the present preferred embodiment, the LED array head is included to form an electrostatic latent image on the photosensitive drum 92. The photosensitive drum 92 and the transfer roller 94 are arranged to oppose each other in a clamped state.

Furthermore, the printing unit 9 includes a paper cassette 96, a pick-up roller 97, a solenoid 98, a paper sensor 99 and a fusing roller 100. Sheets of paper are stored in the paper cassette 96. The pick-up roller 97 picks up one uppermost sheet stored in the paper cassette 96. The solenoid 98 switches whether or not to transmit a drive force of a motor M to the pick-up roller 97. The paper sensor 99 detects that a sheet of paper picked up from the paper cassette 96 by the pick-up roller 97 reaches a predetermined position immediately before the developing unit 91. The fusing roller 100 fuses a toner image onto paper by heating and applying pressure to recording paper on which a toner visible image is transferred.

In addition, a dashed line 101 indicates a transportation path of paper from the paper cassette 96 to the fusing roller 100. The solenoid 98 switches whether or not to transmit the drive force of the motor M from the printer controller 901 to the pick-up roller 97. An output signal N2 indicating whether or not arrival of paper is detected is given from the paper sensor 99 to the CPU 1 through the printer controller 901.

The developing unit 91 preferably includes a plurality of paddles 911 to agitate toner, a photo-electronic sensor 910, and rollers 912 and 913 to transport toner to selectively attach toner to the photosensitive drum 92. The photo-electronic sensor 910 outputs an output signal N3 that is an analog voltage signal. This sensor will be described in detail below.

On the developing unit 91, the toner cartridge 81 is mounted. The toner cartridge 81 is a component that is attached on an upper portion of the developing unit 91, and that replenishes toner into the developing unit 91 at one time. In the toner cartridge 81, a sealing member is removably attached to, for example, a lower opening, and toner is replenished to the developing unit 91 when the sealing member is stripped off. Toner is replenished in a state where the developing unit 91 is removed from the printing unit 9.

A fuse 83 is built in the developing unit 91. The fuse 83 is a member that determines whether or not the developing unit 91 is new when the developing unit 91 is attached to the printing unit 9. When a new developing unit 91 is attached to the printing unit 9, the printer controller 901 melts down the fuse 83.

The printer controller 901 includes the counter 903, and the counter 903 counts the number of times that toner is replenished. The CPU 1 can learn from the counter 903 the number of replenishments, and can also reset the counter 903.

Figure 2:
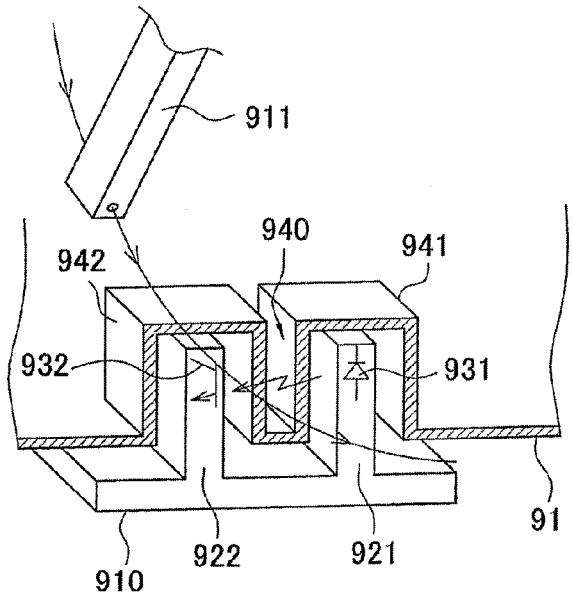
FIG. 2 is a schematic diagram illustrating a photo-electronic sensor and a developing unit cut away near a portion on which the photo-electronic sensor of the image forming device according to a preferred embodiment of the present invention is mounted.

FIG. 2 is a schematic diagram illustrating a photo-electronic sensor and a developing unit cut away near a portion on which the photo-electronic sensor is mounted. Two convex portions 921 and 922 are provided in the photo-electronic sensor 910, and a light emitting unit 931 is built in one convex portion 921 and a light receiving unit 932 is built in the other convex portion 922.

In contrast, in the bottom portion of the developing unit 91, there are provided two adjacent, inward concave portions 941 and 942 into which two convex portions 921 and 922 of the photo-electronic sensor 910 just fit from the lower side of the developing unit 91. At least the opposing portion of the concave portions 941 and 942 is made of a transparent material. Further, one of a plurality of paddles 911 passes through an opposing gap 940 of both of the concave parts 941 and 942 while being rotated.

Accordingly, along with the rotation of the paddle 911, toner flows in the opposing gap 940 together with the paddle 911. When toner is accumulated beyond the top of both of the concave portions 941 and 942 leading to the inside of the developing unit 91, toner will not run out from the opposing gap 940 of both of the concave portions 941 and 942. However, when toner in the developing unit 91 decreases to some degree, there is a period in which there is no toner in the opposing gap 940. This period depends on remaining toner in the developing unit 91.

In contrast therewith, light emitted from the light emitting unit 931 is received by the light receiving unit 932 through the opposing portion of both of the concave portions 941 and 942, and the amount of light received depends on the amount of toner in the opposing gap 940. The photo-electronic sensor 910 outputs a voltage which is proportional to the amount of light received by the light receiving unit 932, to the comparator 103 as the output signal N3.

In the present preferred embodiment, the light receiving unit 932 is configured to output a low voltage when the amount of light received is great and a high voltage when the amount of light received is little, that is, the light receiving unit 932 is configured to output the output signal N3 of the voltage that is inversely proportional to the amount of light received by the light receiving unit 932. In addition, the amount of light received by the light receiving unit 932 varies depending on the presence or absence of the developing unit 91. More specifically, the amount of light received by the light receiving unit 932 varies depending on whether the developing unit 91 with no toner is mounted or the developing unit 91 is not mounted.

The structure provided to detect the remaining toner will be described with reference to FIG. 1. The comparator 103 compares the analog output signal N3 outputted from the photo-electronic sensor 910 with a predetermined threshold voltage Vth. The comparator 103 outputs a signal "1" when the voltage value of the output signal N3 is smaller than the threshold voltage Vth, and outputs a signal "0" as a comparator output Cout in cases other than the above.

In synchronization with a clock signal CLK of a predetermined frequency, the counter 102 samples the above output Cout of the comparator 103. The counter 102 increments a counter value CV when the result is "0", and resets the counter value CV at this time to "0" when the result is "1". Accordingly, the counter value CV of the counter 102 continues to be incremented only when the state where the comparator output Cout is "0" continues. The counter value CV is digital data from "00H" to "FFH" of a hex number. The counter 102 sends the counter value immediately before resetting, to the CPU1 through the printer controller 901.

As described above, the counter 102 constitutes a timing unit, and the counter value CV represents the period in which the output Cout of the comparator that is a comparator unit continues a signal "0" or the rate of the period (that is, the rate of an output High to the entire output signal N3 of the photo-electronic sensor).

In the printing unit 9 having such a configuration, the control signal N1 is given from the CPU 1 to the printer controller 901, so that the motor M is driven to rotate. As a result, a sheet of paper is picked up from the paper cassette 96 by the pick-up roller 97, and is then transported toward the paper sensor 99. When the paper sensor 99 detects arrival of paper and outputs the output signal N2, the CPU 1 outputs image data from the CODEC 902 to the LED array head 95 at a predetermined timing. In this manner, the photosensitive drum 92 rotates while an electrostatic latent image is being formed on the surface thereof and toner being attached selectively by the developing unit 91, so that a toner visible image is formed on the surface of the photosensitive drum 92.

In contrast therewith, paper is transported from the position of the paper sensor 99 to the position where the photosensitive drum 92 and the transfer roller 94 oppose each other and is sent between the photosensitive drum 92 and the transfer roller 94, so that, the toner visible image is transferred on the surface of the paper, and the toner image is fused by being heated and pressured by the fusing roller 100. During this operation, the CPU 1 detects remaining toner in the developing unit 91 based on the counter value CV sent from the counter 102.

For example, a threshold to be compared with the counter value CV is stored in the RAM 3, and the CPU 1 can change and reset the threshold. This threshold is a hex number which is comparable with the counter value CV. Further, the threshold is set to a reasonable, most appropriate value by being defined experimentally.

The operation of detecting remaining toner in the image forming device having the above configuration will be described with reference to the timing charts of FIGS. 3 to 7 illustrating detection results by the photo-electronic sensor 910. First, the change in the amount of light received by the light receiving unit 932 of the photo-electronic sensor 910 will be described.

The photo-electronic sensor 910 makes the light emitting unit 931 emit light at all times. Hence, while the paddle 911 passes the opposing gap 940, the amount of light received by the light receiving unit 932 decreases to almost 0% by being blocked by the paddle 911, however in cases other than the above, the amount of light received by the light receiving unit 932 varies depending on remaining toner. The degree of the decrease in the amount of light received by the light receiving unit 932 due to this remaining toner can be classified into some states as follows.

When remaining toner is almost 100%, the amount of light received by the light receiving unit 932 hardly changes with agitation of toner by the paddle 911, and is maintained at almost 0% at all times. In contrast, when remaining toner is substantially 0%, the amount of light received by the light receiving unit 932 decreases to almost 0% only when the paddle 911 passes the opposing gap 940, and is almost 100% in cases other than that described above.

When remaining toner is the amount other than that described above, with agitation of toner by the paddle 911, a period is produced when there is no toner in the opposing gap 940 after the paddle 911 passes the opposing gap 940. The period and the number of times when there is toner virtually matches remaining toner in the developing unit 91, so that it is possible to detect remaining toner in the developing unit 91 by detecting this period and number of times.

FIGS. 3 to 7 illustrate (a) the output signal N3 of the photo-electronic sensor, (b) the comparator output Cout, (c) the clock signal CLK, and (d) the counter value CV. The output signal N3 of the photo-electronic sensor shows a maximum voltage Vmax, a threshold voltage Vth, and a minimum voltage V0. The maximum voltage Vmax corresponds to the amount of light received 0%, and the minimum voltage V0 corresponds to the amount of light received 100%. The threshold voltage Vth is set to a value slightly higher than the minimum voltage V0. Only when the output signal N3 goes below the threshold voltage Vth, the comparator output Cout is "1". That is, when the output signal N3 is higher than the threshold voltage Vth (when the output is High), the comparator output Cout is "0", and, when the output signal N3 is smaller than the threshold voltage Vth (when the output is Low), the comparator output Cout is "1".

Figure 3:
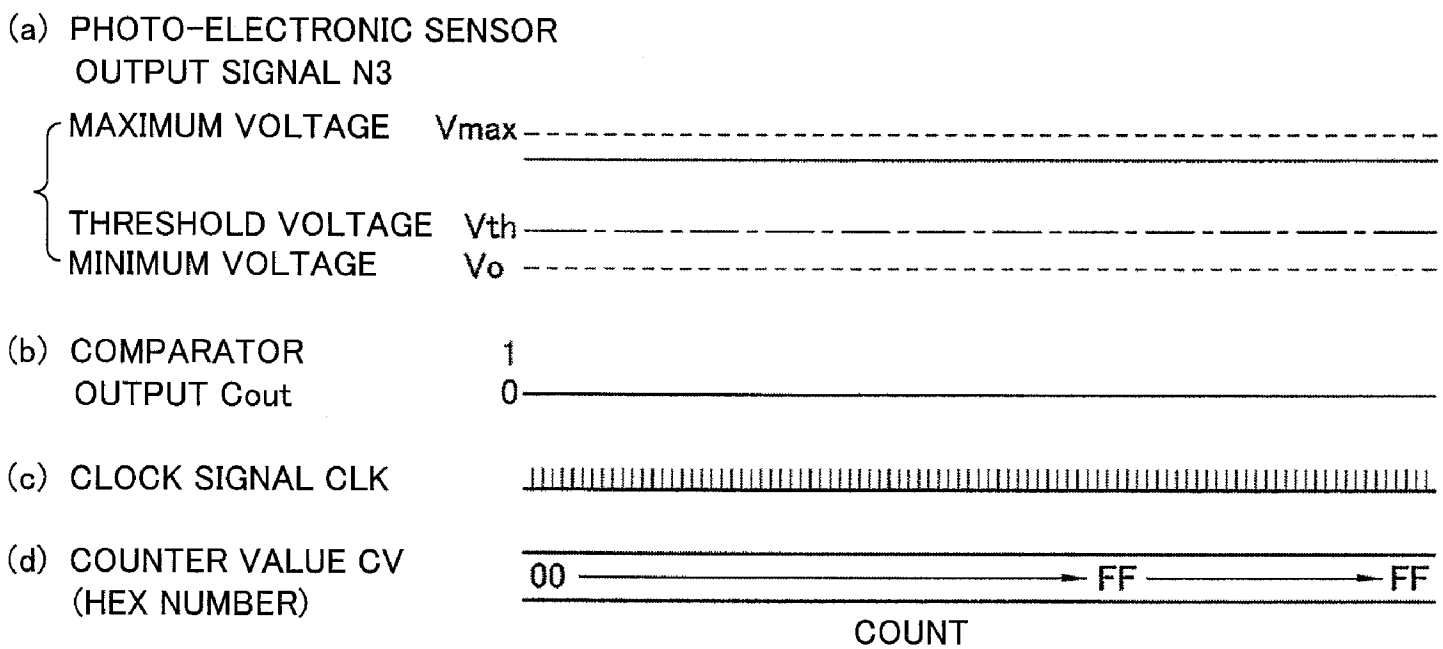
FIG. 3 is a timing chart illustrating an operation state when remaining toner in the developing unit of the image forming device according to a preferred embodiment of the present invention is almost 100%.

First, the state where the developing unit 91 is properly mounted and remaining toner in the developing unit 91 is almost 100%, is illustrated in the timing chart of FIG. 3. In this case, the light receiving unit 932 is placed in an almost complete light blocking state at all times, and therefore, as illustrated in (a) of FIG. 3, the output signal N3 of the photo-electronic sensor 910 is maintained at a value close to the maximum value Vmax.

Accordingly, as illustrated in (b) of FIG. 3, the comparator output Cout is maintained at "0". This comparator output Cout is sampled in synchronization with the clock signal CLK illustrated in (c) of FIG. 3. As illustrated in (d) of FIG. 3, the counter value CV of the counter 102 continues to be incremented from "00H" to "FFH" and maintains "FFH" thereafter, and therefore this value is sent to the CPU 1 through the printer controller 901 as a value before resetting. As a result, the CPU 1 determines that "the sent counter value CV does not reach the threshold (that is, the period of the output High or its rate does not exceed the threshold), and therefore remaining toner is sufficient".

Figure 4:
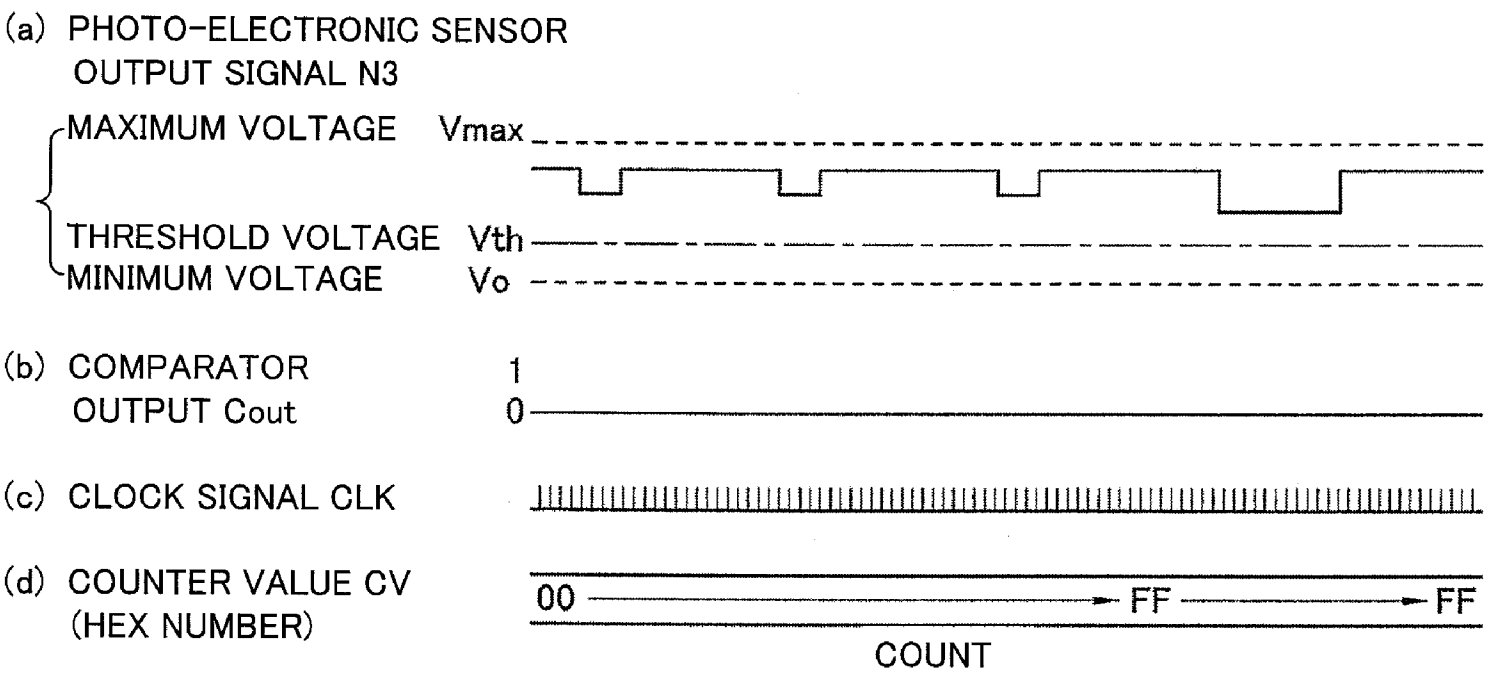
FIG. 4 is a timing chart illustrating an operation state when remaining toner in the developing unit of the image forming device according to a preferred embodiment of the present invention is not 100% but is sufficient.

Next, the state where the developing unit 91 is adequately mounted and remaining toner in the developing unit 91 is not 100% but is sufficient, is illustrated in the timing chart of FIG. 4. In this case, with agitation of toner by the paddle 911, the amount of light received increases immediately after the paddle 911 passes the opposing gap 940, however, in cases other than the above, the light receiving unit 932 is basically placed in an almost complete light blocking state. Therefore, as illustrated in (a) of FIG. 4, the output signal N3 of the photo-electronic sensor 910 is maintained at a value close to the maximum value Vmax, and periodically decreases a little in synchronization with a rotation cycle of the paddle 911.

Accordingly, as illustrated in (b) of FIG. 4, the comparator output Cout is maintained at "0". The output signal of this counter 102 is sampled in synchronization with the clock signal CLK illustrated in (c) of FIG. 4. As illustrated in (d) of FIG. 4, the counter value CV of the counter 102 continues to be incremented from "00H" to "FFH" and maintains "FFH" thereafter, and therefore this value is given to the CPU 1 through the printer controller 901 as a value before resetting. As a result, the CPU 1 determines that "the sent counter value CV does not reach the threshold (that is, the period of the output High or its rate does not exceed the threshold), and therefore remaining toner is sufficient".

Figure 5:
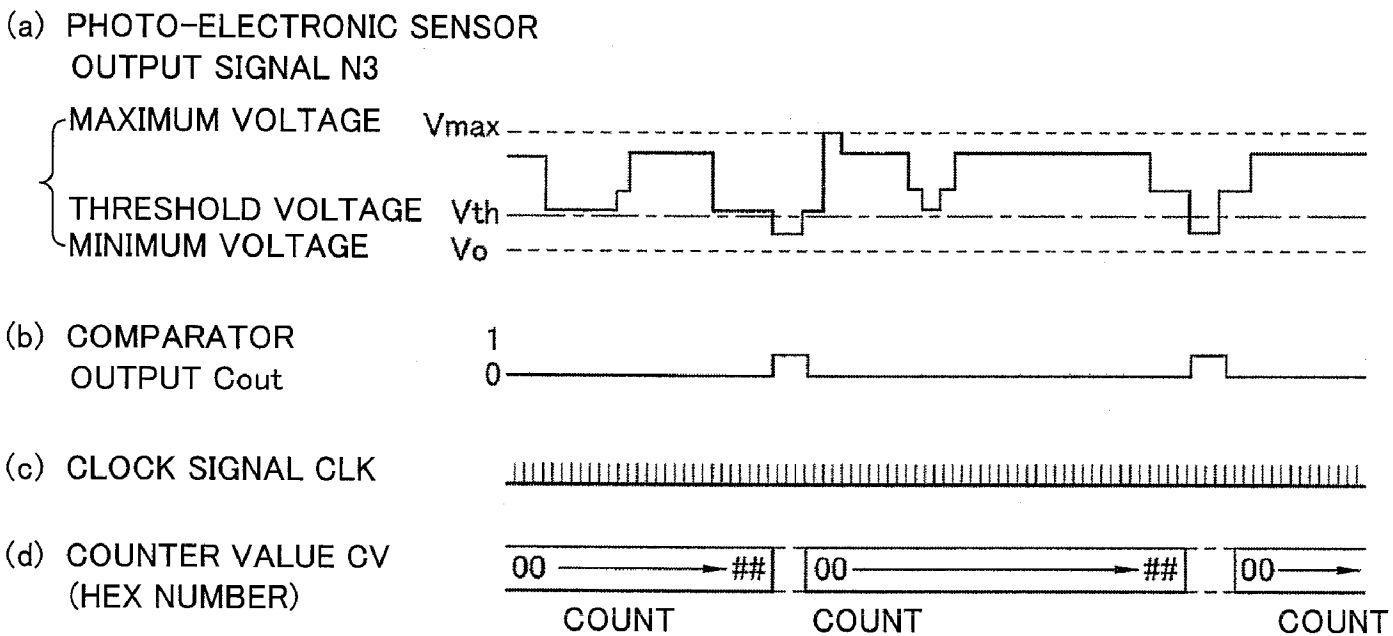
FIG. 5 is a timing chart illustrating an operation state when remaining toner in the developing unit of the image forming device according to a preferred embodiment of the present invention decreases to some extent.

Next, the state where the developing unit 91 is adequately mounted and remaining toner in the developing unit 91 decreases to some extent, is illustrated in the timing chart of FIG. 5. In this case, with agitation of toner by the paddle 911, the light receiving unit 932 is placed in an almost light blocking state at the time when the paddle 911 passes the opposing gap 940, and, immediately after this time, the amount of light received increases over a substantial period of time. The increase in this amount of light received becomes unstable depending on remaining toner, and therefore the amount of light received may increase to a state where there is no toner. Hence, as illustrated in (a) of FIG. 5, a period in which the output signal N3 of the photo-electronic sensor 910 is close to the maximum value Vmax in synchronization with a rotation cycle of the paddle 911, and a period in which, immediately after the former period, the output signal N3 substantially decreases over a certain amount of time, are repeated.

Accordingly, as illustrated in (b) of FIG. 5, although the comparator output Cout basically maintains "0", the comparator output Cout may possibly become "1" depending on cases. By sampling this comparator output Cout in synchronization with the clock signal CLK as illustrated in (c) of FIG. 5, the counter value CV of the counter 102 is basically incremented as illustrated in (d) of FIG. 5.

However, in due course, the comparator output Cout becomes "1", and therefore the counter value CV of the counter 102 is reset to "00H" before reaching "FFH". In this case, the counter value CV given to the CPU 1 through the printer controller 901 is a value "##0" immediately before resetting. Therefore, the CPU 1 determines that "although the sent counter value CV does not reach the threshold (that is, the period of the output High or its rate does not exceed the threshold), the counter value CV is close to the threshold, and therefore remaining toner is not sufficient".

Figure 6:
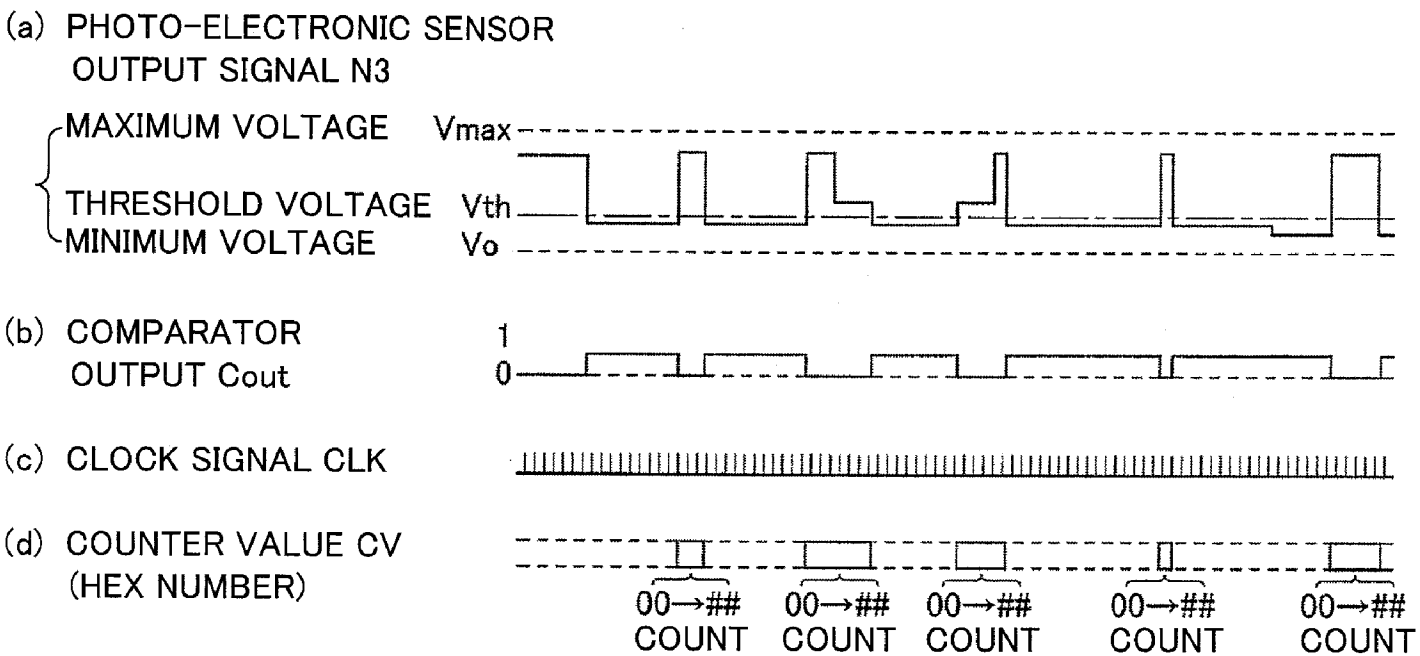
FIG. 6 is a timing chart illustrating an operation state when remaining toner in the developing unit of the image forming device according to a preferred embodiment of the present invention is close to 0%.

Next, the state where the developing unit 91 is adequately mounted and remaining toner in the developing unit 91 is close to 0% and therefore toner needs to be replenished, is illustrated in the timing chart of FIG. 6. In this case, the light receiving unit 932 cyclically repeats a state where, with agitation of toner by the paddle 911, the light receiving unit 932 is placed in an almost light blocking state at the time when the paddle 911 passes the opposing gap 940, and a state where, thereafter, the amount of light received becomes almost 100%. Therefore, as illustrated in (a) of FIG. 6, the output signal N3 of the photo-electronic sensor 910 synchronizes with a rotation cycle of the paddle 911. More specifically, a period in which a value is close to the maximum value Vmax when the paddle 911 passes the opposing gap 940, and a period in which a value is lower than the threshold voltage Vth, are cyclically repeated.

Accordingly, as illustrated in (b) of FIG. 6, the period of the comparator output Cout "0" and the period of the comparator output Cout "1" are cyclically repeated. By sampling the comparator output Cout in synchronization with the clock signal CLK illustrated in (c) of FIG. 6, a result illustrated in (d) of FIG. 6 is obtained. That is, when remaining toner becomes less, the counter value CV of the counter 102 repeats a state where the counter value CV is reset to "00H" when the counter value CV increases to a value "##H" which is close to "00H".

In this manner, the counter value sent to the CPU1 is "##H" which is a small value close to "00H". Hence, the CPU 1 determines that "the sent counter value CV exceeds the threshold (that is, the period of output High or its rate exceeds the threshold), and therefore remaining toner is scarce", and makes the display unit 11 display a lack of toner. When the counter value continues exceeding the threshold a predetermined number of times, the CPU 1 may make the display unit 11 display the lack of toner.

Figure 7:
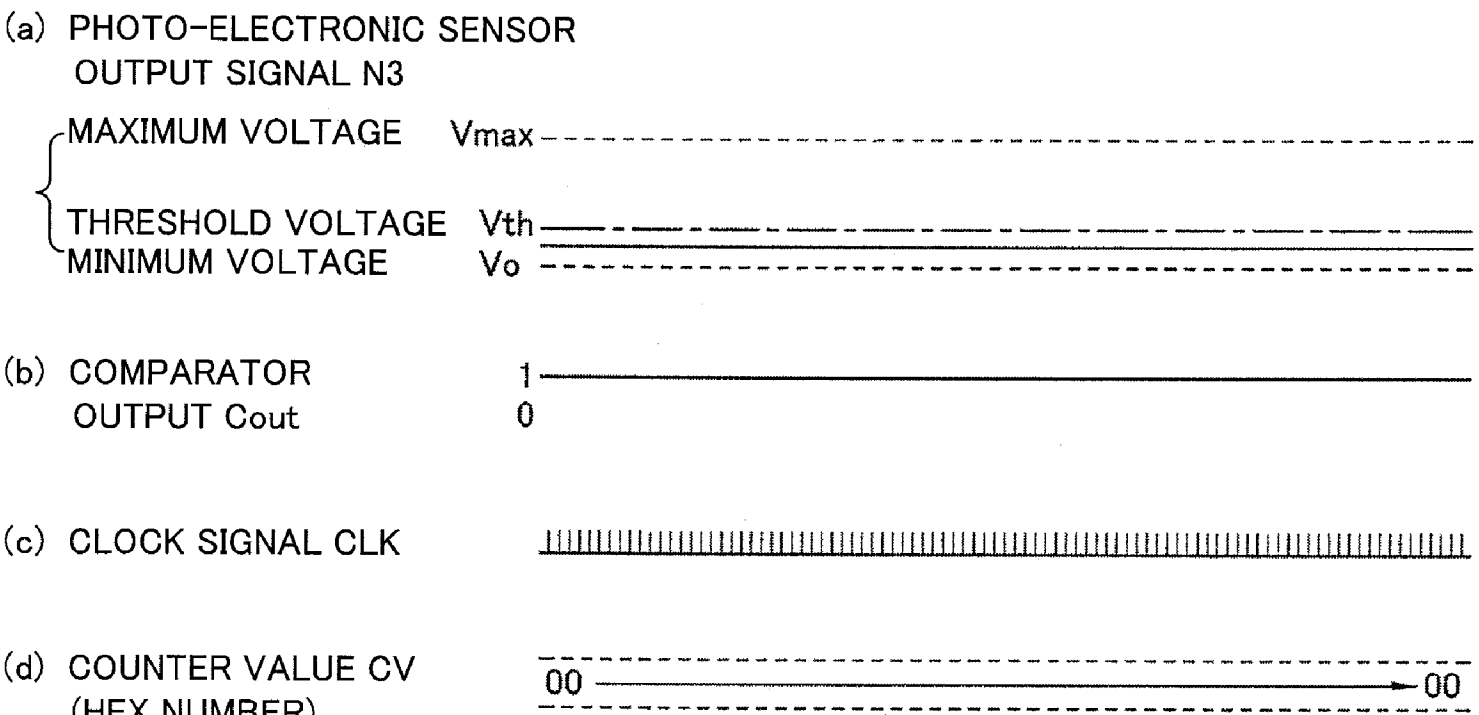
FIG. 7 is a timing chart illustrating an operation state when the developing unit of the image forming device according to a preferred embodiment of the present invention is not mounted.

Next, the state where the developing unit 91 is not mounted is illustrated in the timing chart of FIG. 7.

In this case, since there are no developing unit 91 and no paddles and the light receiving unit 932 is not cyclically placed in the light blocking state with rotation of the paddle 911, the amount of light received is almost 100% at all times. Therefore, as illustrated in (a) of FIG. 7, the output signal N3 of the photo-electronic sensor 910 is maintained close to the minimum voltage V0 at all times. Accordingly, as illustrated in (b) of FIG. 7, the comparator output Cout maintains "1" at all times. By sampling the comparator output Cout in synchronization with the clock signal CLK as illustrated in (c) of FIG. 7, the counter value CV of the counter 102 continues being reset as illustrated in (d) of FIG. 7. This state is detected by the CPU 1 through the printer controller 901, so that the CPU 1 can determine that the developing unit 91 is not mounted.

In this manner, it is possible to determine the remaining toner based on the period of the output High or its rate in a predetermined period, and detect remaining toner and accurately issue an alarm for the lack of toner.

As described above, although the operation of the counter 102 which is the timing unit and determination of remaining toner made in the CPU 1 utilizing a counter value CV are preferably performed at all times, such a determination is not necessary in most cases other than cases where an alarm for the lack of toner must be issued.

Hence, in a preferred embodiment of the present invention, a remaining amount determination start value Vth0 (not illustrated) which is used to start determination of remaining toner and which is a predetermined value of the output signal N3 of the photo-electronic sensor is defined, and a series of determinations may be made when the output signal N3 is smaller than this remaining amount determination start value Vth0. Accordingly, the CPU does not need to perform complicated processing for determining the remaining amount.

In the above preferred embodiment, if the remaining amount determination start value Vth0 is the threshold voltage Vth of the comparator 103 that is the comparator unit, when the comparator output Cout becomes "1", more specifically, when the state of FIG. 5 is obtained, a series of determinations may be made. However, the remaining amount determination start value Vth0 and the threshold voltage Vth may not always be the same.

Further, even when the CPU 1 issues an alarm for the lack of toner, some of the toner is usually still left and images of a certain number of sheets can be formed thereafter. Accordingly, by stopping printing when predetermined sheets of paper are printed after an alarm for the lack of toner is issued, the following advantages can be obtained. That is, while images cannot be formed beyond the boundary where printing quality becomes poor, printing is possible to some degree even after the alarm for the lack of toner is issued. As a result, convenience of the device is improved.

In the above preferred embodiment, although the correspondence between the amount of light received by the photo-electronic sensor and the output signal preferably is inversely proportional, the correspondence of a proportional type is possible and, in this case, determination of comparison by the comparator may be made opposite. Further, the image forming device according to preferred embodiments of the present invention is applicable irrespective of whether toner is magnetic toner or non-magnetic toner.

Figure 8:
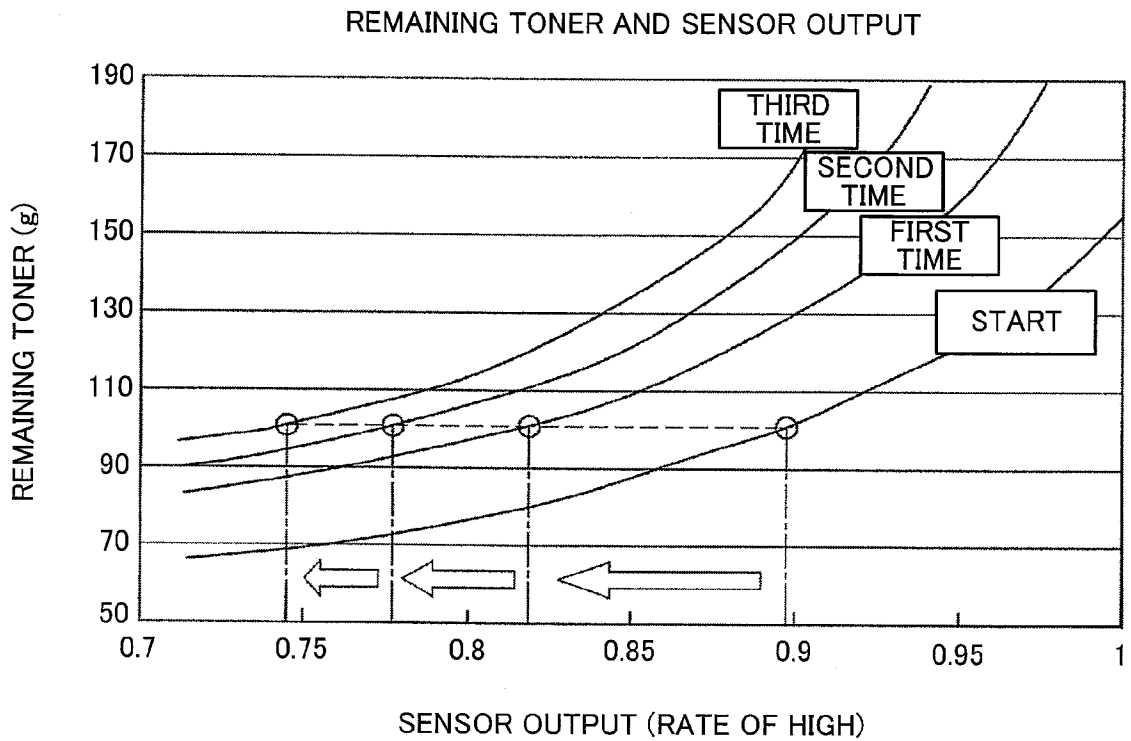
FIG. 8 is a graph illustrating a relationship between remaining toner and a sensor output.

The relationship between remaining toner and a sensor output will be described with reference to FIG. 8. FIG. 8 is a graph illustrating the relationship between the remaining toner and the sensor output. In FIG. 8, the threshold is illustrated by the rate of the sensor output High instead of a hex number.

In FIG. 8, a plurality of curves illustrating the relationship between the remaining toner and the sensor output based on each number of times of exchanging a toner cartridge (the number of times of replenishing toner) are drawn. More specifically, a curve of "start" when the toner cartridge 81 is not exchanged, a curve of "first time" when the toner cartridge 81 is exchanged once, a curve of "second time" when the toner cartridge 81 is exchanged twice, and a curve of "third time" when the toner cartridge 81 is exchanged three times, are illustrated. Each curve is an upward-sloping curve in which the sensor output increases as remaining toner increases, and curves with a greater number of exchanges (replenishments) are positioned higher.

In view of the above, if the number of times of exchanging the toner cartridge 81 is different from a given value of the sensor output, it means that remaining toner is different, and if the threshold is constant as in the conventional example, remaining toner corresponding to the same value of the sensor output increases as the number of times of exchanging the toner cartridge 81 increases. For example, when the sensor output 0.9 is set to a threshold to detect remaining toner of 100 g, the results are that, when the sensor output reaches the threshold, remaining toner is 130 g if the exchange is the first time, remaining toner is 150 g if the exchange is the second time, and remaining toner is 170 g if the exchange is the third time.

Thus, in the preferred embodiments according to the present invention, by changing the threshold of the sensor output every time the number of times of exchanging the toner cartridge 81 increases, the remaining toner is made constant when the sensor output reaches the threshold.

As described above, as the number of times of exchanging the toner cartridge 81 increases, the device changes the threshold to be compared with the sensor output, to a level at which an alarm is hardly issued. Accordingly, remaining toner in the developing unit 91 hardly increases every time the toner cartridge is exchanged, and as a result, toner in the developing unit 91 is efficiently utilized.

Figure 9:
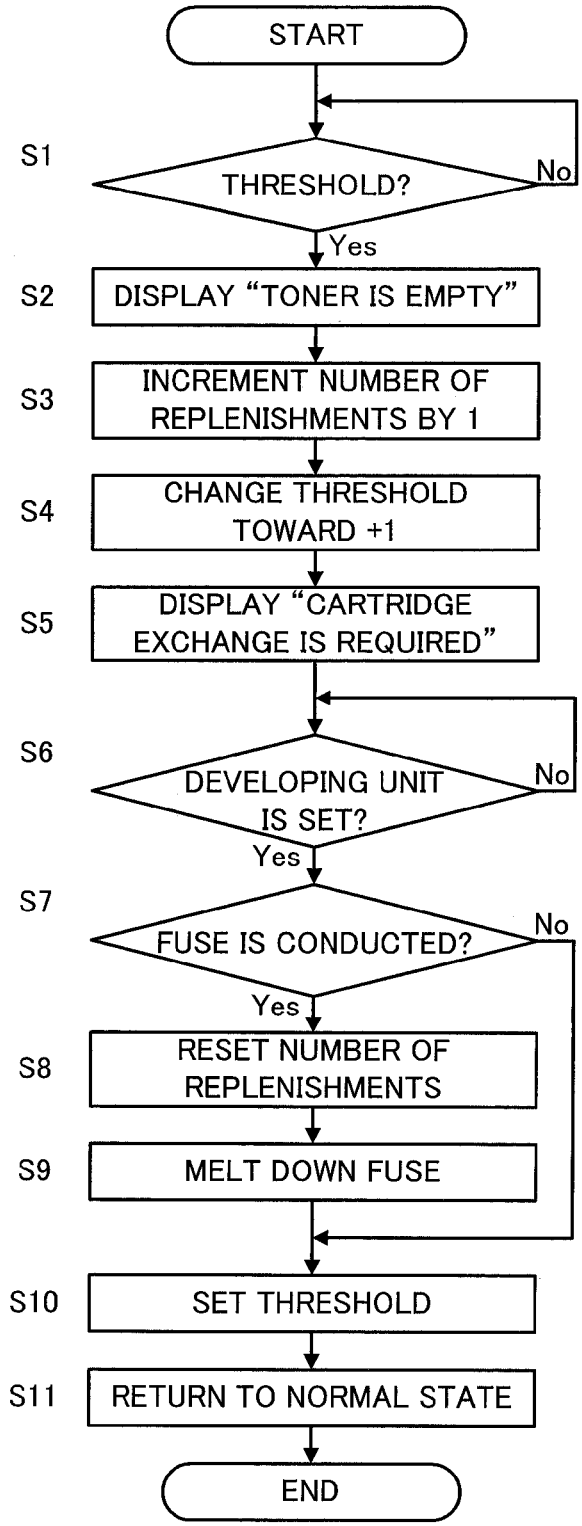
FIG. 9 is a flowchart illustrating toner empty detection and toner replenishment control according to a first preferred embodiment of the present invention.

Toner empty detection and a toner replenishment control operation will be described with reference to FIG. 9. FIG. 9 is a flowchart illustrating toner empty detection and toner replenishment control in a first preferred embodiment of the present invention.

In step S1, the CPU 1 determines whether or not the counter value CV from the counter 102 reaches the threshold. When the counter value CV reaches the threshold, the processing proceeds to step S2.

In step S2, the CPU 1 displays on the display unit 11 that "toner is empty". At this time, the CPU 1 may issue an alarm by an audio sound from a load speaker.

In step S3, the CPU 1 increments the number of replenishments in the counter 903 by 1.

In step S4, when the number of replenishments is incremented by 1, the threshold is changed to a new value. In step S5, the CPU 1 displays on the display unit 11 that "an exchange of a toner cartridge is required".

In step S6, the CPU 1 waits for the developing unit 91 to be attached to the printing unit 9. When the developing unit 91 is attached, the processing proceeds to step S7.

In step S7, the CPU 1 determines whether or not the fuse 83 is conducted. If conducted, the processing proceeds to step S8, and if not conducted, the processing proceeds to step S10.

In step S8, since the developing unit 91 is new, the CPU 1 resets the number of replenishments in the counter 903.

In step S9, the CPU 1 melts down the fuse 83.

In step S10, the CPU 1 sets the threshold of the counter value CV. When a new developing unit is set (Yes in step S6→step S8→step S9→step S10), the threshold is set to the value of "start". When the developing unit 91 that is used once or more is set (No in step S7→step S10), the threshold takes the value set in step S4. In step S11, the CPU 1 returns to the normal state.

Figure 10:
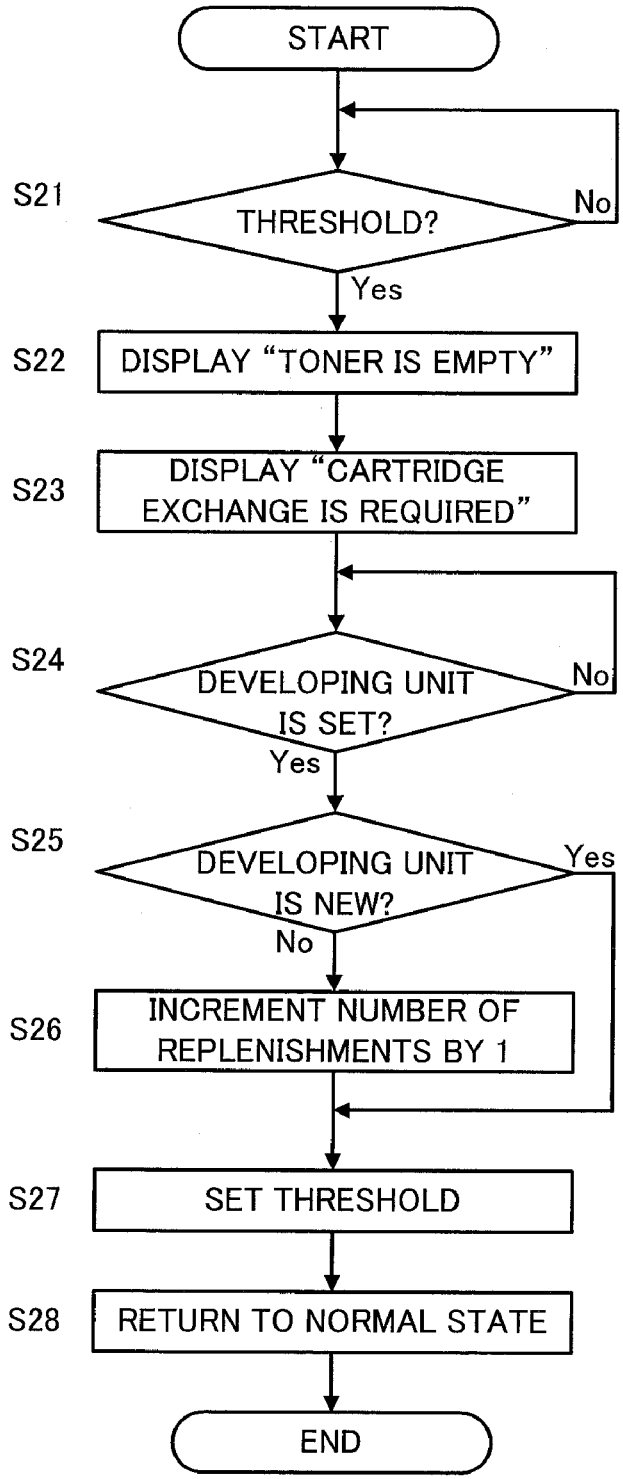
FIG. 10 is a flowchart illustrating toner empty detection and toner replenishment control according to a second preferred embodiment of the present invention.

Toner empty detection and a toner replenishment control operation will be described with reference to FIG. 10. FIG. 10 is a flowchart illustrating toner empty detection and toner replenishment control according to a second preferred embodiment of the present invention.

In this preferred embodiment, differently from the first preferred embodiment, a fuse is not built-in in the developing unit 91, and instead, a radio frequency identification (RFID (not illustrated)) is built-in. The RFID stores information indicating whether or not the developing unit 91 is new, and toner replenishment count information.

In step S21, the CPU 1 determines whether or not the sensor output reaches the threshold. When the sensor output reaches the threshold, the processing proceeds to step S2.

In step S22, the CPU 1 displays on the display unit 11 that "toner is empty". At this time, the CPU 1 may issue an alarm by an audio sound from a loud speaker.

In step S23, the CPU 1 displays on the display unit 11 that "toner cartridge exchange is required".

In step S24, the CPU 1 waits for the developing unit 91 to be attached to the printing unit 9. When the developing unit 91 is attached, the processing proceeds to step S25.

In step S25, the CPU 1 determines whether or not the developing unit 91 is new by using the RFID. If new, the processing proceeds to step S27 and, if not new, the processing proceeds to step S26.

In step S26, since the developing unit 91 is not new, the CPU 1 increments the number of toner replenishments stored in the RFID by 1.

In step S27, the CPU 1 sets the threshold of the sensor output. When a new developing unit is set (Yes in step S25→step S27), the threshold is set to the value of the curve of "start". When a developing unit that is used once or more is set (No in step S25→step S26→step S27), the threshold is set to a value matching the number of replenishments set in step S26.

In step S28, the CPU 1 returns to a normal state.

Although preferred embodiments of the present invention has been described above, the present invention is not limited to the above preferred embodiments, and can be variously modified within the scope that does not deviate from the gist of the invention.

Although the sensor provided to detect remaining toner preferably is a photo-electronic sensor in the above preferred embodiments, other types of sensors may also be used.

Although an output signal from the photo-electronic sensor preferably is outputted to the comparator in the above preferred embodiments, the output signal from the photo-electronic sensor may be outputted directly to the CPU. In this case, for example, an analog to digital (A/D) converter is provided in the CPU, and the A/D converter digitizes the output signal. The CPU measures the number of consecutive periods in which the number of times that is greater or smaller than a predetermined value among a plurality of detection results in the photo-electronic sensor is greater than a predetermined number, and compares the result with the threshold.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An image forming device comprising:

a developing unit;

a toner cartridge arranged to replenish toner to the developing unit at one time;

a toner sensor arranged to detect the toner in the developing unit;

a signal processing unit arranged to process an output signal from the toner sensor to create comparison data, then compare the comparison data with a predetermined threshold, and issue an alarm when the comparison data exceeds the predetermined threshold; and a counter arranged to count the number of times that the toner has been replenished to the developing unit; wherein when the number of counts in the counter increases, the signal processing unit changes the threshold to a level at which the alarm is hardly issued.

2. The image forming device according to claim 1, wherein the developing unit includes an agitator;

the toner sensor is a photo-electronic sensor;

the photo-electronic sensor repeats alight transmitting state and a light blocking state during agitation of toner by the agitator;

the signal processing unit measures a light blocking period or a rate of the light blocking period of the photo-electronic sensor as the comparison data; and as the number of counts in the counter increases, the signal processing unit decreases the threshold.

3. The image forming device according to claim 1, wherein the counter is counted up every time the signal processing unit issues an alarm.

4. The image forming device according to claim 1, wherein the toner is non-magnetic toner.

5. The image forming device according to claim 1, further comprising:

a fuse provided in the developing unit; and a replenishment detecting unit arranged to melt down the fuse when the fuse is conducted and detect that the toner is replenished, wherein the counter is incremented by 1 when the replenishment detecting unit detects that the toner is replenished.

6. An image forming method comprising the steps of:

detecting toner in a developing unit using a toner sensor;

processing an output signal from the toner sensor to create comparison data;

comparing the comparison data with a threshold;

issuing an alarm when the comparison data exceeds the threshold;

detecting that toner is replenished and counting up a counter; and changing the threshold to a level at which the alarm is hardly issued, based on the number of counts in the counter.

7. The image forming device according to claim 6, further comprising a step of calculating a light blocking period or a rate of the light blocking period of a photo-electronic sensor as comparison data, the photo-electronic sensor being the toner sensor.

* * * * *